US008549792B2

(12) United States Patent
Heselden

(10) Patent No.: US 8,549,792 B2
(45) **Date of Patent: *Oct. 8, 2013**

(54) PROTECTIVE SHELTER

(75) Inventor: James Heselden, Leeds (GB)
(73) Assignee: Hesco Bastion Limited, Leeds, Yorkshire (GB)

( * ) Notice: Subject to any disclaimer, the term of this patent is extended or adjusted under 35 U.S.C. 154(b) by 221 days.

This patent is subject to a terminal disclaimer.

(21) Appl. No.: 12/937,888

(22) PCT Filed: Oct. 23, 2009

(86) PCT No.: PCT/GB2009/051431
§ 371 (c)(1),
(2), (4) Date: Oct. 20, 2010

(87) PCT Pub. No.: WO2010/052484
PCT Pub. Date: May 14, 2010

(65) Prior Publication Data

US 2011/0041678 A1 Feb. 24, 2011

(30) Foreign Application Priority Data

Nov. 7, 2008 (GB) ..... 0820411.7

(51) Int. Cl.
*E04B 7/00* (2006.01)

(52) U.S. Cl.
USPC ..... 52/22; 52/86; 52/169.1; 52/339; 52/633; 135/124; 135/87; 135/906

(58) Field of Classification Search
USPC ..... 52/169.1, 169.14, 388, 339, 340, 52/365, 404.1, 408, 632, 633, 634, 690, 691, 52/692, 506.06, 506.07, 3, 4, 22, 23, 86, 52/87, 88; 135/124, 87, 609
See application file for complete search history.

(56) References Cited

U.S. PATENT DOCUMENTS 2,793,720 A * 5/1957 Hawes ..... 52/640
3,206,896 A 9/1965 Hayes (Continued)

FOREIGN PATENT DOCUMENTS

EP 1992768 11/2008
FR 856983 8/1940

(Continued)

OTHER PUBLICATIONS

International Search Report of International Application No. PCT/GB2009/051431 (Form PCT/ISA/210).

(Continued)

*Primary Examiner* — Chi Q Nguyen
(74) *Attorney, Agent, or Firm* — Ping Wang; Andrews Kurth LLP

(57) ABSTRACT

A protective shelter offering opposite outer supports and a roof structure extending between the supports, wherein the roof structure comprises a plurality of tray members arranged to receive earth, sand or aggregate material defining an inner skin to provide a first level of protection in the roof structure, and the tray members are arranged to be supported by transverse beams, wherein the transverse beams are arranged to be supported at their respective ends by the opposite outer supports and wherein the transverse beams form a transverse beam bridge across the shelter such that the height of the shelter centrally, and away from the opposite supports is substantially the same as the height of said supports.

17 Claims, 9 Drawing Sheets

(56) References Cited

U.S. PATENT DOCUMENTS

| | | | | |
|---|---|---|---|---|
| 3,820,294 | A | 6/1974 | Parker | |
| 3,832,958 | A * | 9/1974 | Hiorth | 109/1 R |
| 4,590,721 | A * | 5/1986 | Berg et al. | 52/169.1 |
| 4,722,155 | A * | 2/1988 | Ericsson | 52/79.1 |
| 5,655,338 | A * | 8/1997 | Lucas | 52/169.6 |
| 5,740,643 | A * | 4/1998 | Huntley | 52/265 |
| 7,353,642 | B1 * | 4/2008 | Henriquez | 52/741.41 |
| 7,856,761 | B2 * | 12/2010 | Heselden | 52/22 |

FOREIGN PATENT DOCUMENTS

| | | |
|---|---|---|
| GB | 2449328 | 11/2008 |
| WO | 2008139211 | 11/2008 |

OTHER PUBLICATIONS

Search Report of Application No. GB0820411.7.

International Preliminary Report on Patentability (Application No. PCT/GB2009/051431, filed Oct. 23, 2009).

* cited by examiner

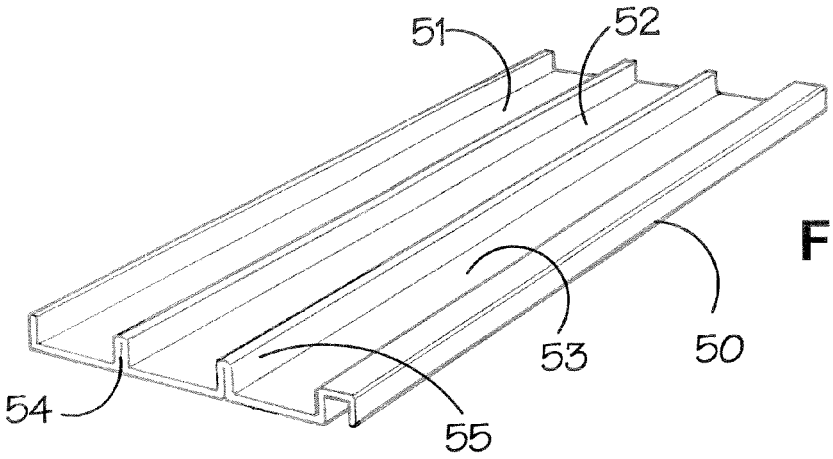
FIG.5.
FIG.6.
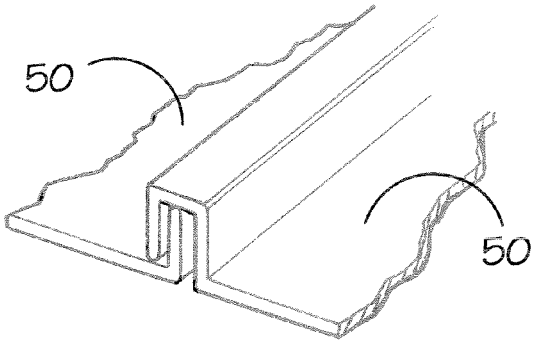
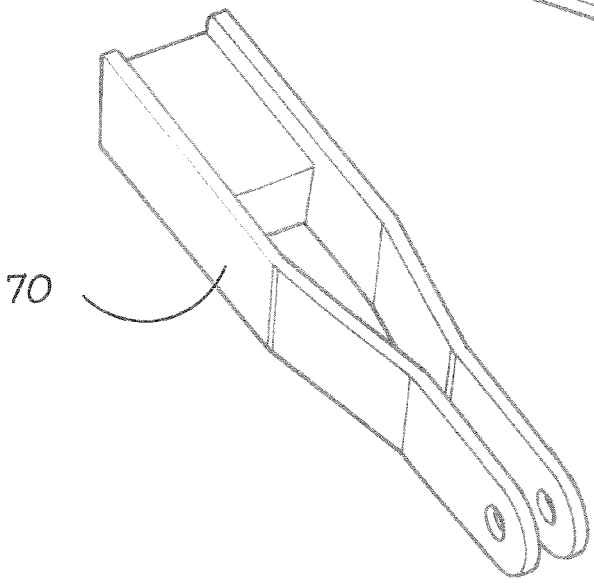
FIG.7.

PROTECTIVE SHELTER

FIELD

The present invention relates to a protective shelter and, in particular, to such a shelter that can provide protection within a war zone and which can be readily assembled in a quick, secure and reliable manner.

BACKGROUND

While a variety of requirements arise for temporary, or at least quickly-built shelters, there is generally a compromise between the level of protection offered by the shelter and the speed, reliability and ease with which such a structure can be built.

Also, the degree of protection required by the shelter can change over time and known protective shelters, while perhaps providing an appropriate initial level of protection, may not be suited to a scenario in which a lesser, or greater, degree of protection is required.

Our co-pending application PCT/GB2008/050275 describes certain types of shelter which utilise a shallow-arched roof structure to provide support for a ballast material to protect the shelter from explosive attack.

However, we have found that the provision of a shallow-arched roof structure is not always the most desirable manner of protection, and this invention seeks to provide for a protective shelter having certain advantages over known such shelters.

BRIEF DESCRIPTION OF THE FIGURES

The invention is described further hereinafter, by way of example only, with reference to the accompanying drawings in which:

FIG. 5 is a perspective view of a tray member to be supported between neighbouring pairs of transverse roof beams;

FIG. 6 shows in a close up detail a perspective view of two interlocking tray members;

FIG. 7 shows a perspective view of a swivel bracket for supporting the frame of the detonation screen;

DETAILED DESCRIPTION

Figure 1:
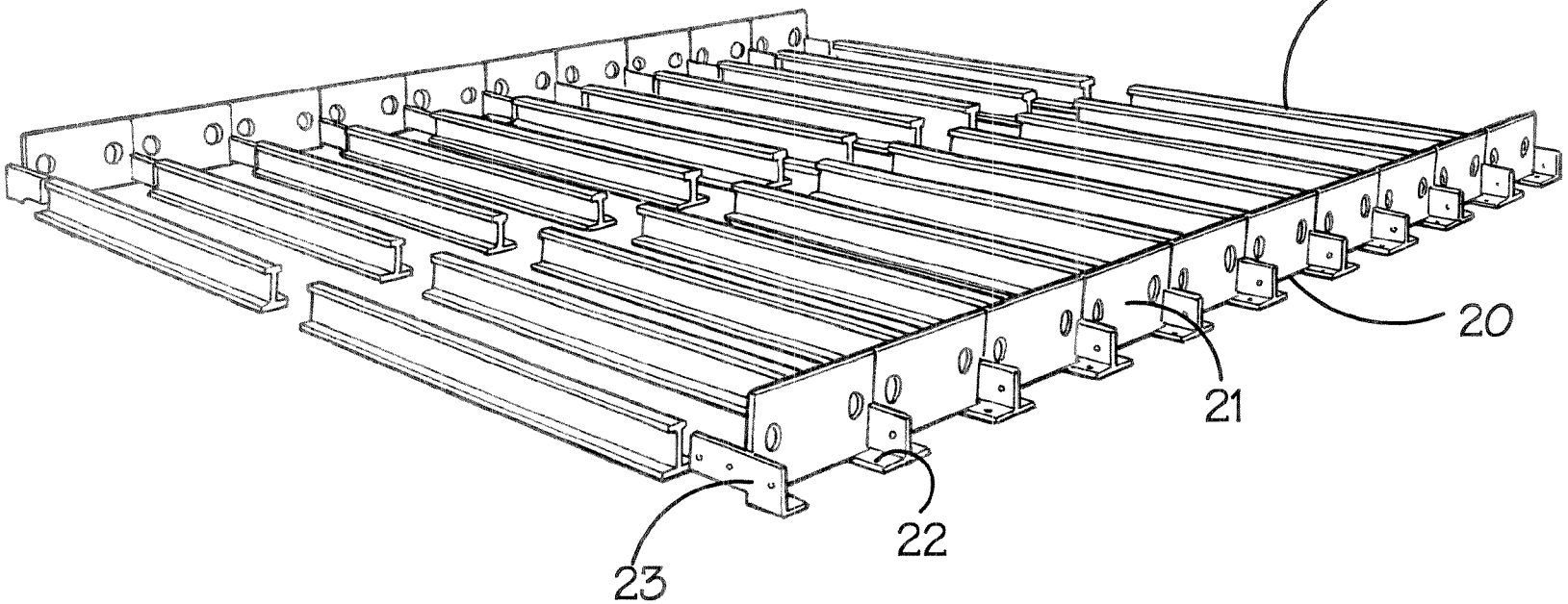
FIG. 1 is a perspective view showing in pre-assembled form a number of starting components for building a protective shelter according to an embodiment of the present invention.

As will be appreciated from the following description, examples of a shelter embodying the present invention can be quickly and, importantly, reliably constructed in a manner requiring a minimum number of personnel and, critically, in a manner such that each separate component of the structure can be removed and lifted, preferably single handedly.

Also, all separate components can advantageously be of a size such that they are readily transportable, in flat-packed unassembled form on a pallet, such as a pallet of dimensions 2 meters×2.2 meters.

As will be appreciated, the invention provides for a protective shelter offering opposite outer supports and a roof structure extending between the supports, wherein the roof structure comprises a plurality of tray members arranged to receive earth, sand or aggregate material defining an inner skin to provide a first level of protection in the roof structure, and the tray members are arranged to be supported by transverse beams, wherein the transverse beams are arranged to be supported at their respective ends by the opposite outer supports and wherein the transverse beams form a transverse beam bridge across the shelter such that the height of the shelter centrally, and away from the opposite supports is substantially the same as the height of said supports.

The transverse beam bridge structure exhibited by the present invention has been found to provide a shelter which has excellent stability and capability to withstand explosive attack. Whilst the shallow-arched structures described in our co-pending application PCT/GB2008/050275 also offer excellent performance in these regards, we have surprisingly found that the extent to which the shelter is able to withstand incoming explosive attack is by no means unacceptably compromised in the transverse beam bridge structure of the present invention. Moreover, in certain scenarios the transverse beam bridge structure of the present invention may offer certain advantages over the shelters described in PCT/GB2008/050275. For example, in building the shelters of the present invention, the transverse beam bridge structure allows a greater degree of flexibility (or for that matter margin of error) in positioning of the outer supports of the shelter. For a given size of shelter, it is possible in the shelter of the present invention to provide the necessary roof coverage with relatively less material, thereby making the shelter rather more straightforward to construct; less costly; and of lighter construction. Another possible advantage of the transverse beam bridge structure of the invention is that the resulting shelters are more easily able to be constructed side by side on a modular basis. It is therefore envisaged that one important advantage of the shelters of the invention will be their ready susceptibility to be extended when required. For example, a shelter built in a military camp to serve as a mess tent, a hospital, or a sleeping quarter may readily be extended when a demand for additional space arises.

The invention also provides for a protective shelter offering opposite outer supports and a roof structure extending between the supports, wherein the roof structure comprises a plurality of tray members arranged to receive earth, sand or aggregate material defining an inner skin to provide a first level of protection in the roof structure, and the tray members are arranged to be supported by transverse beams, wherein the transverse beams are arranged to be supported at their respective ends by the opposite outer supports and wherein the transverse beams form an arch-less transverse beam bridge across the shelter.

Also provided in accordance with the present invention is a protective shelter offering opposite outer supports and a roof structure extending between the supports, wherein the roof structure comprises a plurality of tray members arranged to receive earth, sand or aggregate material defining an inner skin to provide a first level of protection in the roof structure, and the tray members are arranged to be supported by transverse beams, wherein the transverse beams are arranged to be supported at their respective ends by the opposite outer supports and wherein the transverse beams form an arch-less transverse beam bridge across the shelter such that the height of the shelter centrally, and away from the opposite supports is substantially the same as the height of said supports.

The transverse beam bridge is preferably substantially flat; running straight across the shelter from outer support to opposite outer support. However it is also envisaged that other geometries may be contemplated—zigzag or irregular for example—and such geometries are considered to be within the scope of this invention, provided the bridge does not form a structure in which the height of the shelter in its central region is substantially different from its height at or towards an or each outer support and/or does not form an arched structure. It may even be contemplated to build a shelter in accordance with the invention by constructing the roof barn assembly as a series of mini-arches, zigzags or other regularly or irregularly repeated units. However, if the overall impact of this is that the roof as a whole is generally the same height in the central region of the shelter as it is at one or both sides, towards an or each outer support, and/or that the roof as a whole does not exhibit a single arch extending from one outer support to the other; then such a construction is considered to be encompassed by this invention in its broadest embodiments.

In order to assist the quick and reliable formation of such a flat bridge structure, the supporting transverse beams members advantageously comprise transverse beams of identical shape and configuration. Each transverse beam member may comprise a plurality of transverse beams joined together end-to-end by any suitable connecting means, such as one or more flitch plates for example.

A greater plurality of beam members—for example three, four or five—may be provided end-on end, with suitable connecting members; although in this case it may be necessary for the shelter to be provided with one or more internal stanchions for supporting the roof beam assembly.

In a preferred embodiment, each transverse beam is provided by two transverse beam members joined end to end. Preferably, each transverse beam member is identical. Preferably, a vertical member of the transverse beams includes sections to accommodate flitch plates, for supportively connecting the transverse beams. Preferably still, the sections are controlled tolerance channels in the transverse beams. Advantageously, securing the transverse beams with the flitch plates in this manner creates a strong continuous transverse roof beam.

Preferably, each roof beam member is joined end-to-end with its paired roof beam member in a manner which provides a continuous straight-line join.

The ends of the transverse beams are arranged to be supported by the outer supports, and may be advantageously be arranged to be received by anchor assemblies.

The anchor assemblies advantageously serve to space the transverse beams along the length of the shelter and are arranged such that each transverse beam is effectively connected to, in a secure manner, and sandwiched between, adjacent anchor assembly units. Alternatively, it can be considered that each anchor assembly unit is effectively securely connected to, and sandwiched between, adjacent transverse beams.

In any case, the anchor assembly units, through their secure engagement to the transverse roof beams, provide for a rigid footing/support structure that extends along the length of the upper surface of the walls of the shelter and thereby combine to effectively define a lintel transverse beam extending along the length of the wall. Such rigid supporting structure provided by the interconnected anchor assembly units serves to define the aforementioned lintel transverse beam in a manner such that, should the outer wall suffer damage, or the integrity thereof be in any way compromised, the rigidity and stability of the overall roof structure can remain intact advantageously serving to retain the roof structure in place in spite of any such damage to the wall(s).

The structure of the invention can advantageously include a second laterally extending layer, spaced from the tray members and arranged so as to define a pre-detonation screen.

The pre-detonation screen is advantageously spaced from the initial layer formed by the tray members and the soil, sand, aggregate layer by a distance in the order of from about 0.5 meters to about 2 meters, for example.

Preferably, the tray members comprise a series of inter connected identical tray members having mutually connectable engagement formations at opposite ends thereof.

Preferably each tray member comprises a plurality of tray sections. Each tray section may be separated from its neighbouring tray section by a stiffening flange to give extra structural robustness to the tray member.

As a further feature, the portions of the roof structure provided above the earth, sand or aggregate layer can advantageously be formed from the inter connected metal poles, for example such as scaffold poles.

Such poles are arranged to provide roof trusses and rafter poles, within the overall structure of the roof. As one example, the pre-detonation screen can comprise plywood panels having a thickness of 19 mm.

As should be appreciated from the above, and from the description below, the invention is particularly advantageous insofar as the roof structure can be readily formed on gabion units which are arranged to form the opposite walls of the shelter.

The wall structures can be formed from structural blocks such as those that are the subject matter of European Patent 0466726. Continuous wall structures, and other types of modular wall structure (concrete blocks for example) are also contemplated.

The overall protective shelter can then be quickly and reliably constructed as required, and in a manner responsive to the level of danger faced, and the level of protection required.

For example, once the gabions are in place to form the walls of the shelter, the roof structure can be readily, reliably formed, requiring a minimal number of personnel and, through use of the component parts described herein, in a structurally rigid and reliable manner so as to first provide a basic level of blast protection by way of the transverse beams and an interlaid series of connected trays, as described further herein, and the layer of earth, sand or other aggregate provided thereon.

The level of protection can be further enhanced by inclusion of a pre-detonation screen which, again, can be constructed in a fast, efficient and reliable manner as and when required.

An adaptable degree of protection can then advantageously be provided by a shelter embodying the present invention.

Turning first to FIG. 1, there is provided a perspective view showing in pre-assembled form a number of starting components for building a protective shelter according to an embodiment of the present invention. The pre-assembly comprises in this case 22 identical straight roof beams 10, each in this case being of T-beam structure, the T-beam being inverted eventually to receive the tray members between neighbouring T beam sections. Between neighbouring beams and at each end thereof are provided anchor assembly units 20.

Each anchor assembly unit 20 comprises a vertically extending face plate 21 supported on each side by a pair of horizontally extending foot plates 22. Transversely extending side plates 23 are provided for connection of the anchor assembly unit at each end with a roof beam 10. The connection is not shown in FIG. 1, this figure displaying a pre-assembled form of roof assembly, but may be provided by means of flitch plates or other suitable connecting means, for example.

Figure 2:
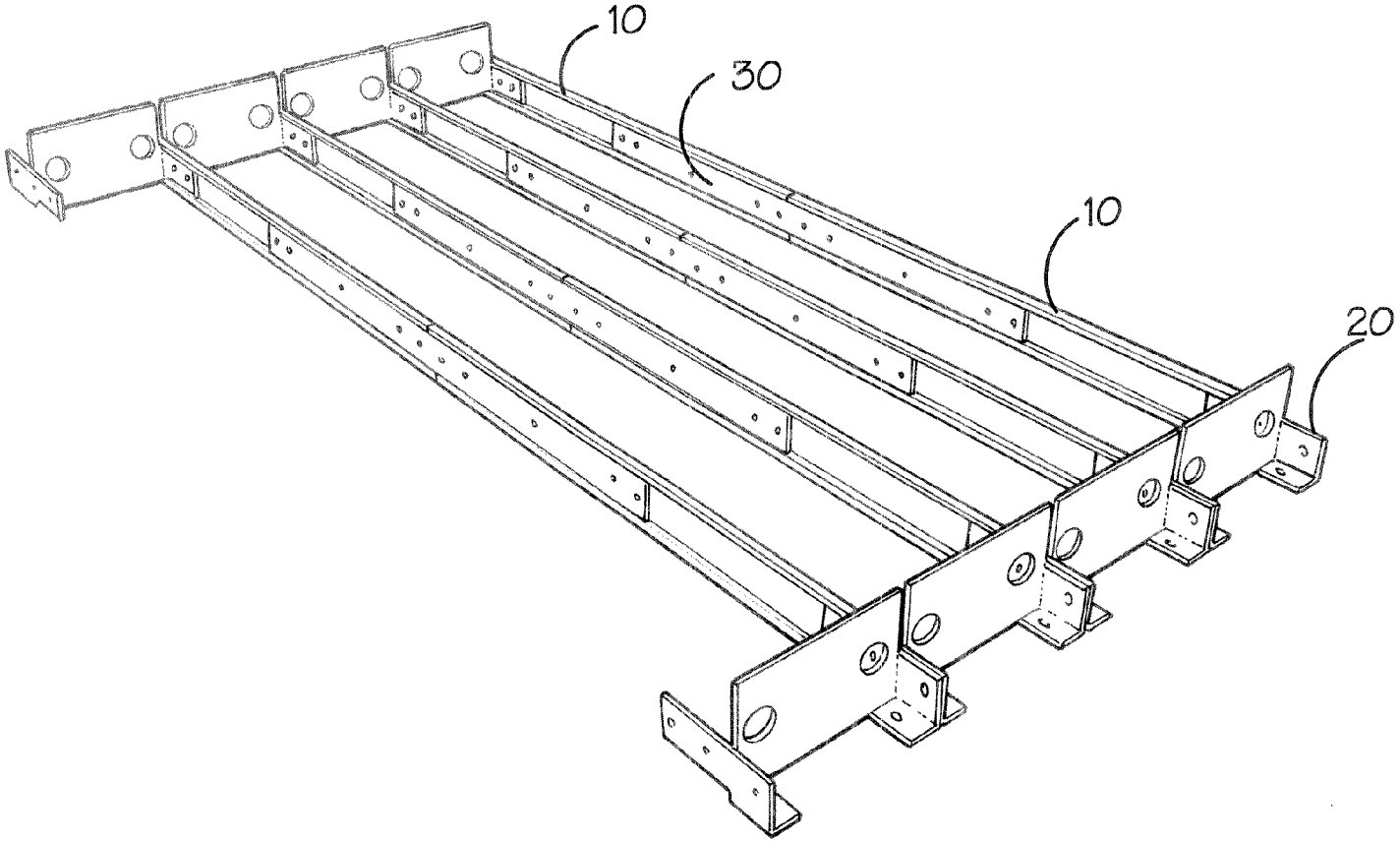
FIG. 2 is a perspective view showing the initial stages of assembly of a protective shelter in accordance with the invention.

FIG. 2 illustrates an early stage assembly of a first section of the roof structure. Conjoined pairs of roof beams 10 are connected end-to-end by means of flitch plates 30. Preferably a connecting flitch plate is provided on either side of the join between two conjoined roof beams 20, although the perspective in FIG. 2 renders only one such plate 30 visible on each conjoined roof beam pair.

Whilst in theory it would be possible to pre-assemble the entire roof structure before mounting the structure on opposed outer supports, it is found to be preferable to assemble the structure in separate components before mounting (usually by means of a fork lift truck for example) each separate component on the outer supports and then completing their interconnection to provide a coherent and unitary structure as the roof assembly. FIG. 2 shows the pre-assembly of a first (of three in this case) components of the roof assembly.

As well as the connection by means of flitch plates 30 of end-on end roof beam pairs, FIG. 2 also illustrates with respect to this first component of the roof beam assembly the interconnection of the roof beam ends with the anchor beam assemblies. In this case, the vertical sections of each inverted T beam simply engage (and are secured by means of connecting bolts, for example) with the side plates of each anchor beam assembly as shown. Already, however it will be seen that the ultimate effect of such interconnection along the length of the assembly is that the individual anchor assembly units cooperate with each other and with their interleaved roof beam sections to provide a lintel structure, which eventually will rest on the opposite outer supports of the shelter and provide effective support for the roof assembly as a whole.

Figure 3:
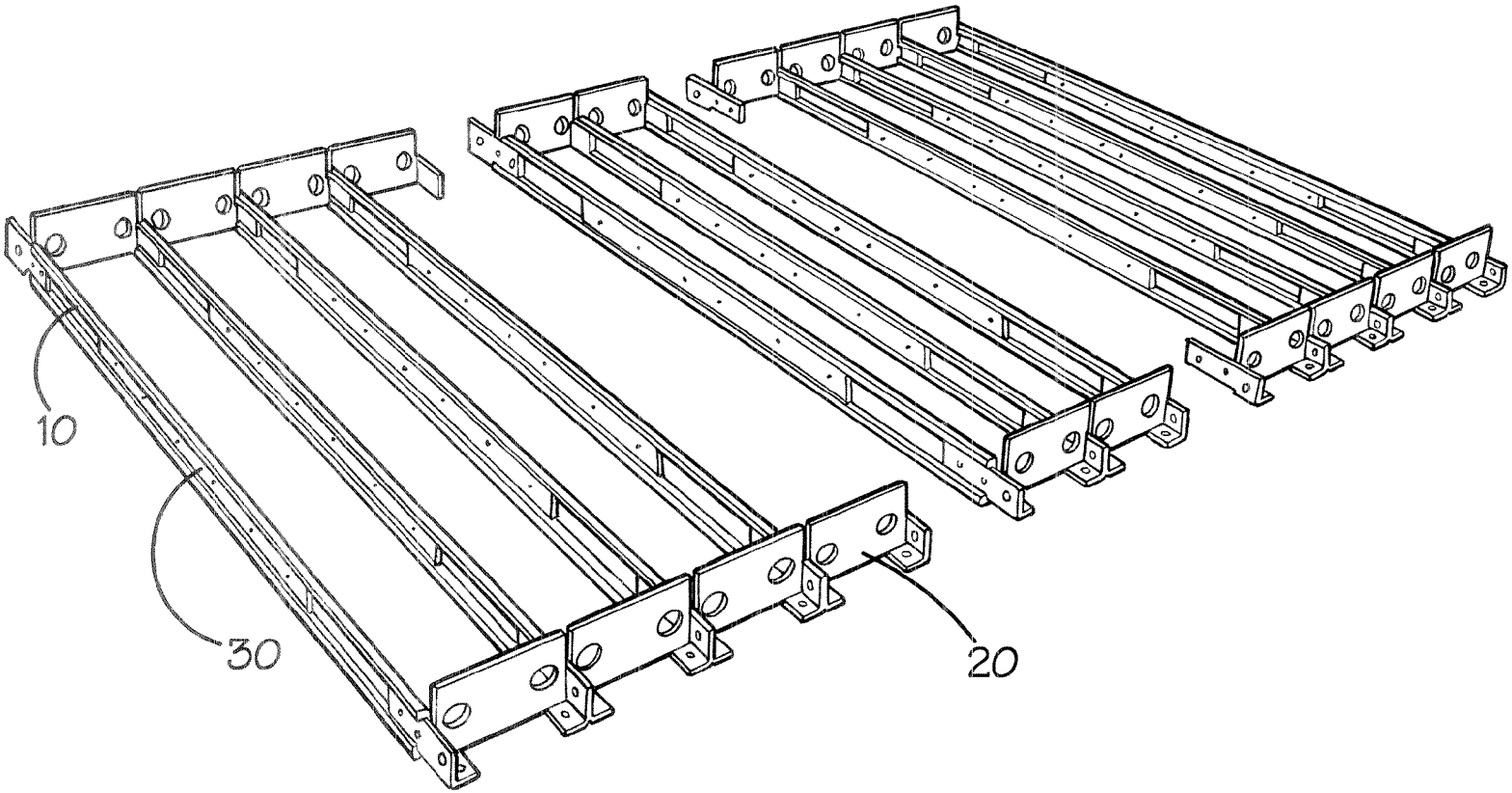
FIG. 3 is a further perspective view showing three separate sections of the roof structure of in assembled form.

FIG. 3 shows the same assembly as FIG. 2 but together with the second and third components of the roof beam assembly—the connections in each being as described in relation to the first component depicted in FIG. 2. Again it should be emphasised that the separate pre-assembly of these three components is merely one of many ways that can be envisaged of assembling the roof structure, and indeed the shelter itself.

Figure 4:
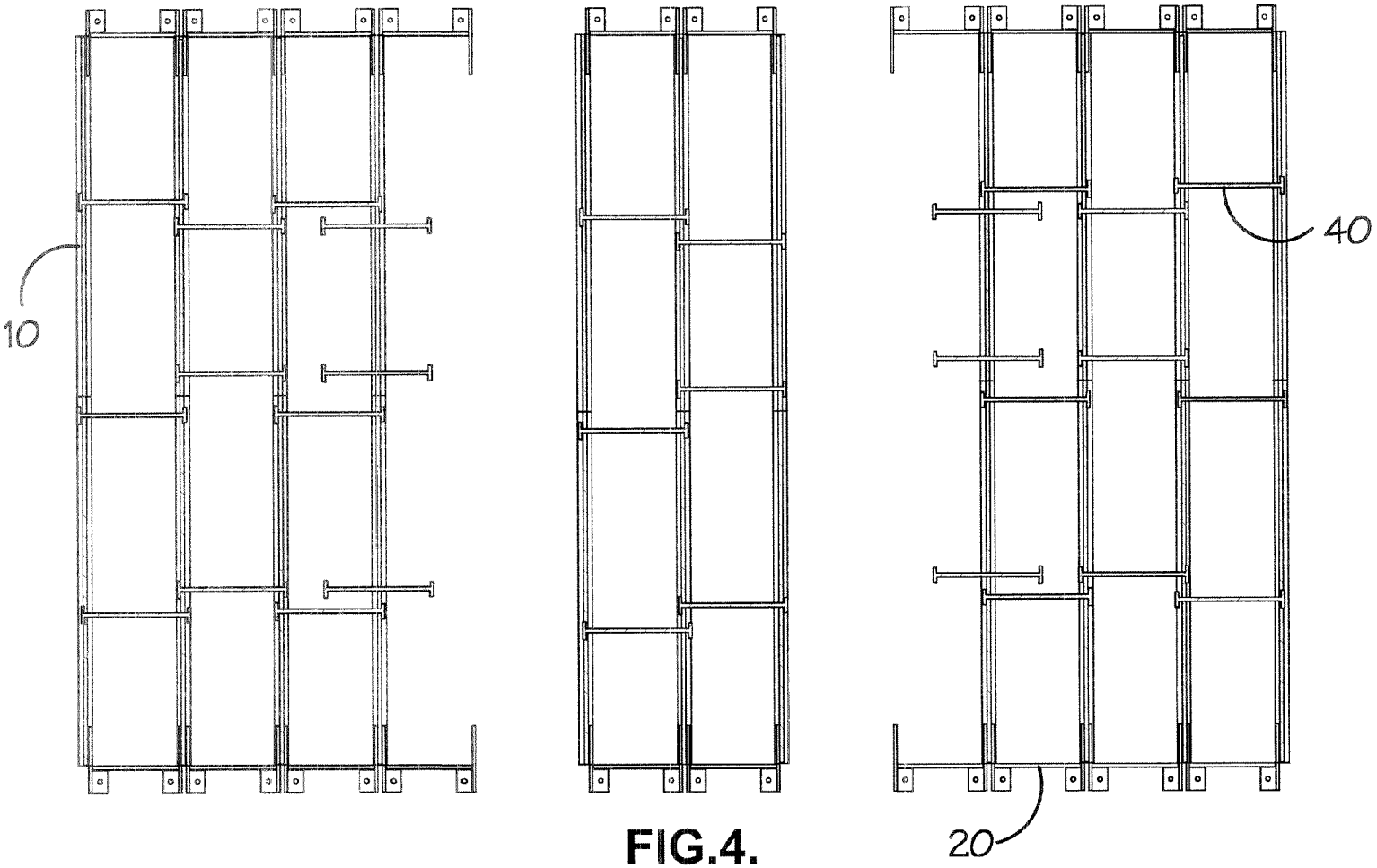
FIG. 4 is a plan view of the FIG. 3 assembly, in which pairs of transverse roof beams are braced together.

Whilst not essential, it has been found desirable to brace the neighbouring roof beam pairs together, and this is shown in FIG. 4 where various brace members (provided for example by means of threaded steel bars 40) are provided to this effect. The brace members have the advantage of controlling the interstitial space between neighbouring roof beam pairs—ie maintain a uniform gap between them—and of ensuring that the roof beams themselves maintain a vertical and regular orientation.

At some stage, whether before or after mounting the roof beams on the outer supports, it is necessary to close the gap between neighbouring roof beam pairs and also provide a means for allowing the roof structure to carry a ballast material—sand, earth, gravel, rocks, concrete, snow—etc.—to provide added protection from incoming explosive attack. In the shelter of the invention this is achieved by means of tray members which essentially do three things:

They are adapted to slot in between neighbouring roof beam pairs and close the gap therebetween They are arranged to interlock with each other along the transverse length of the roof beam gap to provide a continuous section.

They are capable of receiving and retaining a ballast material by means of one or more tray compartments.

An example of a tray member in accordance with the invention is shown in FIG. 5. In the depicted example each tray member comprises three separate tray compartments 51, 52 and 53—separated by interstitial vertical flanges 54 which provide additional strength and rigidity in the tray member, and also facilitate retention of the ballast component.

It will be appreciated that many other tray member designs and configurations may be contemplated. In preferred embodiments of this invention discrete, inter-connectable units are preferred because this facilitates ease of construction, and particularly ease of shipping and storage but in principle provided the tray members are able effectively to support a ballast material in a manner which ameliorates the effect on the shelter of incoming explosive attack, any such design is suitable.

FIG. 6 shows in detailed expansion the interconnection between neighbouring tray members in one preferred embodiment of the invention.

Figure 8:
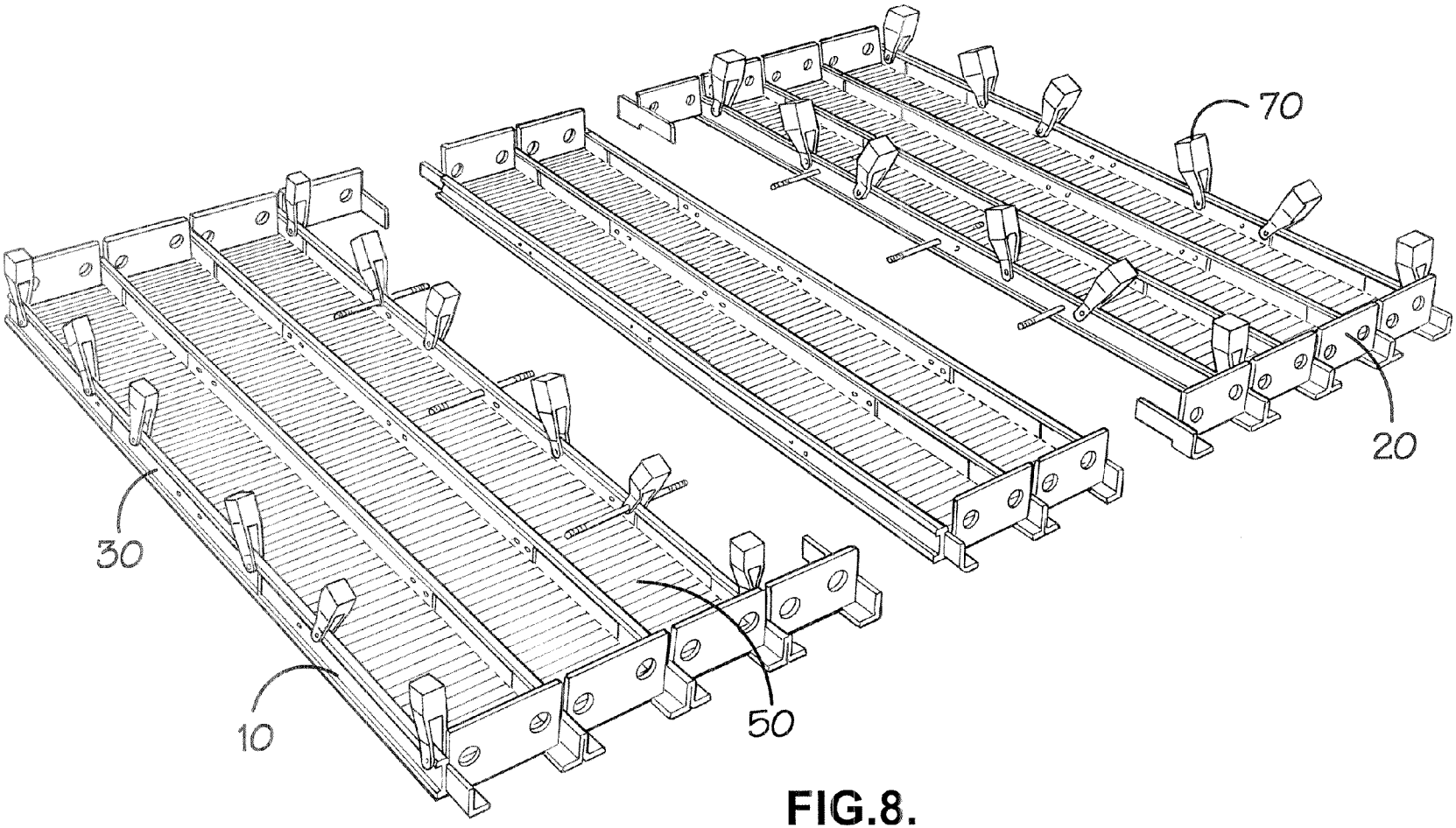
FIG. 8 is a perspective view of the assembly of FIG. 4, with interlocked tray members closing the gaps between opposing transverse roof beams, and with swivel brackets mounted for construction of the framework for the detonation screen.

FIG. 7 shows in a detailed perspective view a swivel bracket for use in supporting on the roof beam assembly a framework for a pre-detonation screen. Swivel brackets 70 may be mounted on certain roof beams as shown in FIG. 8, which Figure also shows tray members 50 mounted and serially interconnected between opposing roof beam pairs.

Figure 9:
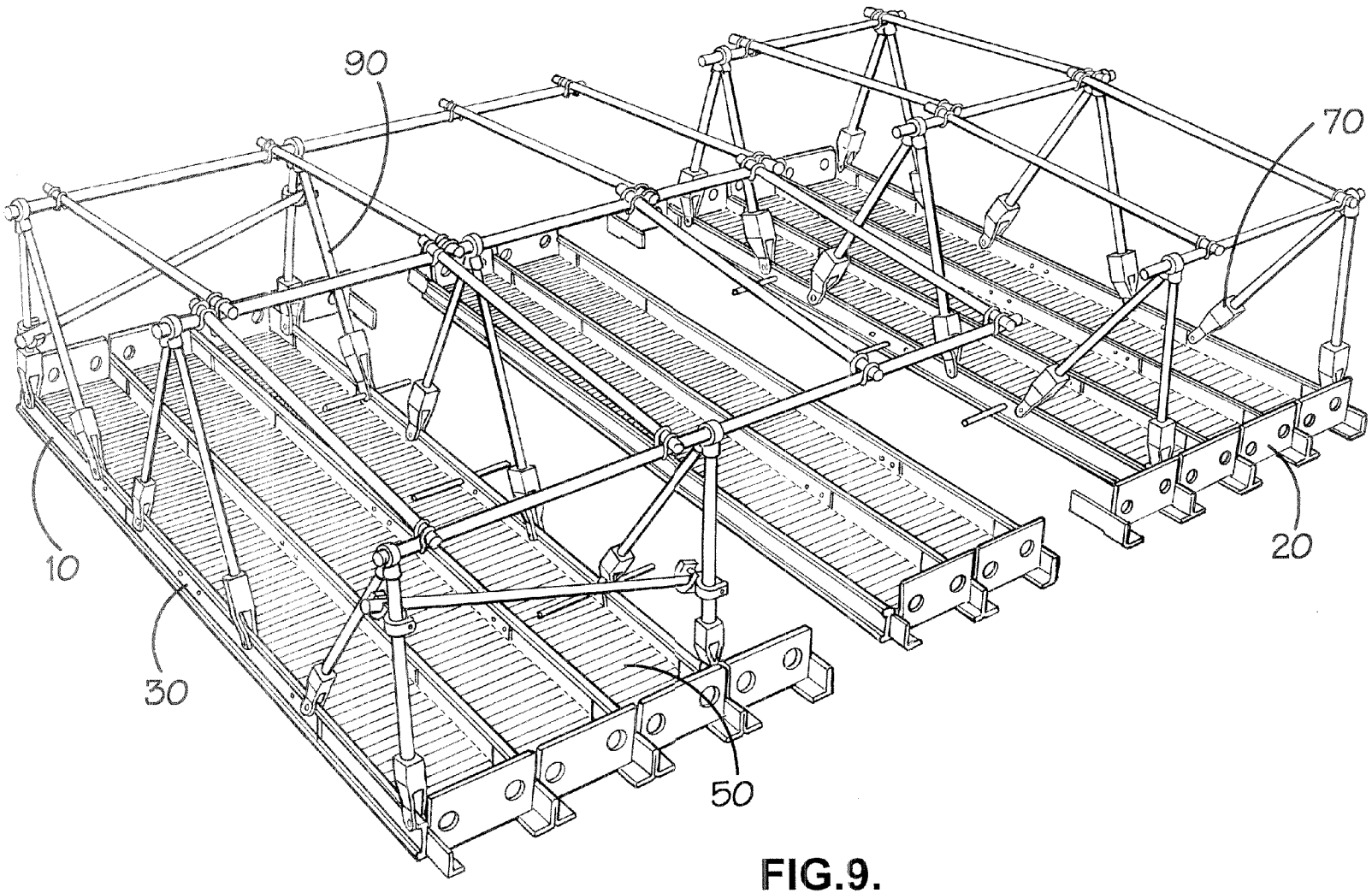
FIG. 9 is a perspective view of the FIG. 8 assembly, in further construction of the framework for the detonation screen.

Swivel brackets 70 are adapted to receive scaffolding members 90 which may be constructed in any suitable manner, one of which is shown in FIG. 9, to provide a framework for supporting a pre-detonation screen.

Figure 10:
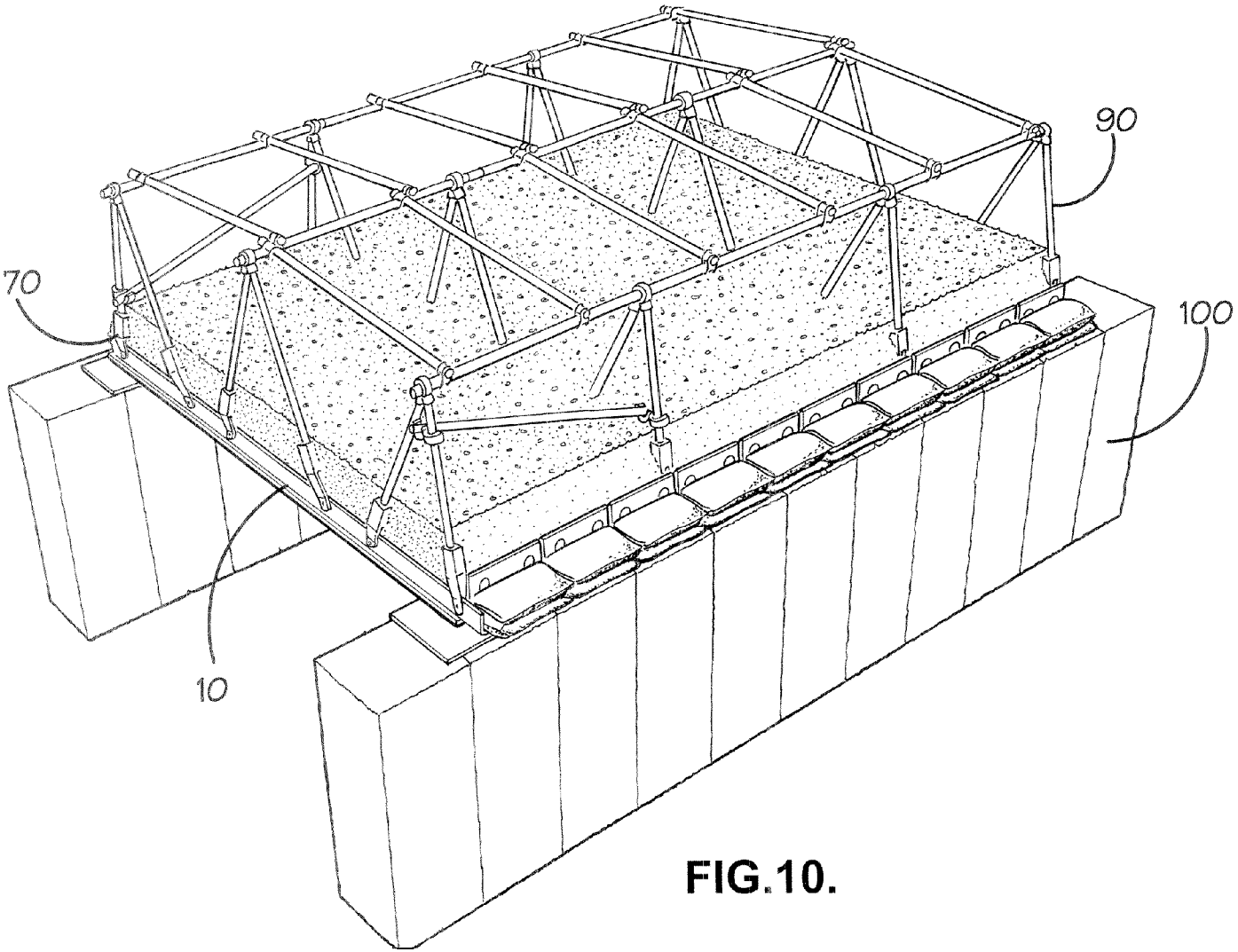
FIG. 10 is a perspective view of the FIG. 9 assembly mounted on outer supports, and connected together, the interlocked tray assemblies carrying a fill material and covered with a fabric liner.

In the illustrated embodiment, the roof assembly and pre-detonation screen framework of FIG. 9 is pre-assembled as shown as three separate components which are then mounted, by means of a fork-lift for example, on opposed outer supports 100 and interconnected as shown in FIG. 10. It will be appreciated that many other modes of construction are possible. For example, the anchor assembly units and roof beams may be mounted directly on opposite outer supports before interconnection, and the remainder of the assembly may then take place with the roof assembly already in its support-mounted position.

The outer supports shown in FIG. 10 may be of any suitable design or construction—concrete blocks or gabion units for example. In some cases a continuous wall may be preferred to provide the or each outer support.

The tray members are filled with a suitable ballast material, and then, in the embodiment shown in FIG. 10, covered with a suitable lining material—tarpaulin or geotextile for example to provide water proofing.

Figure 11:
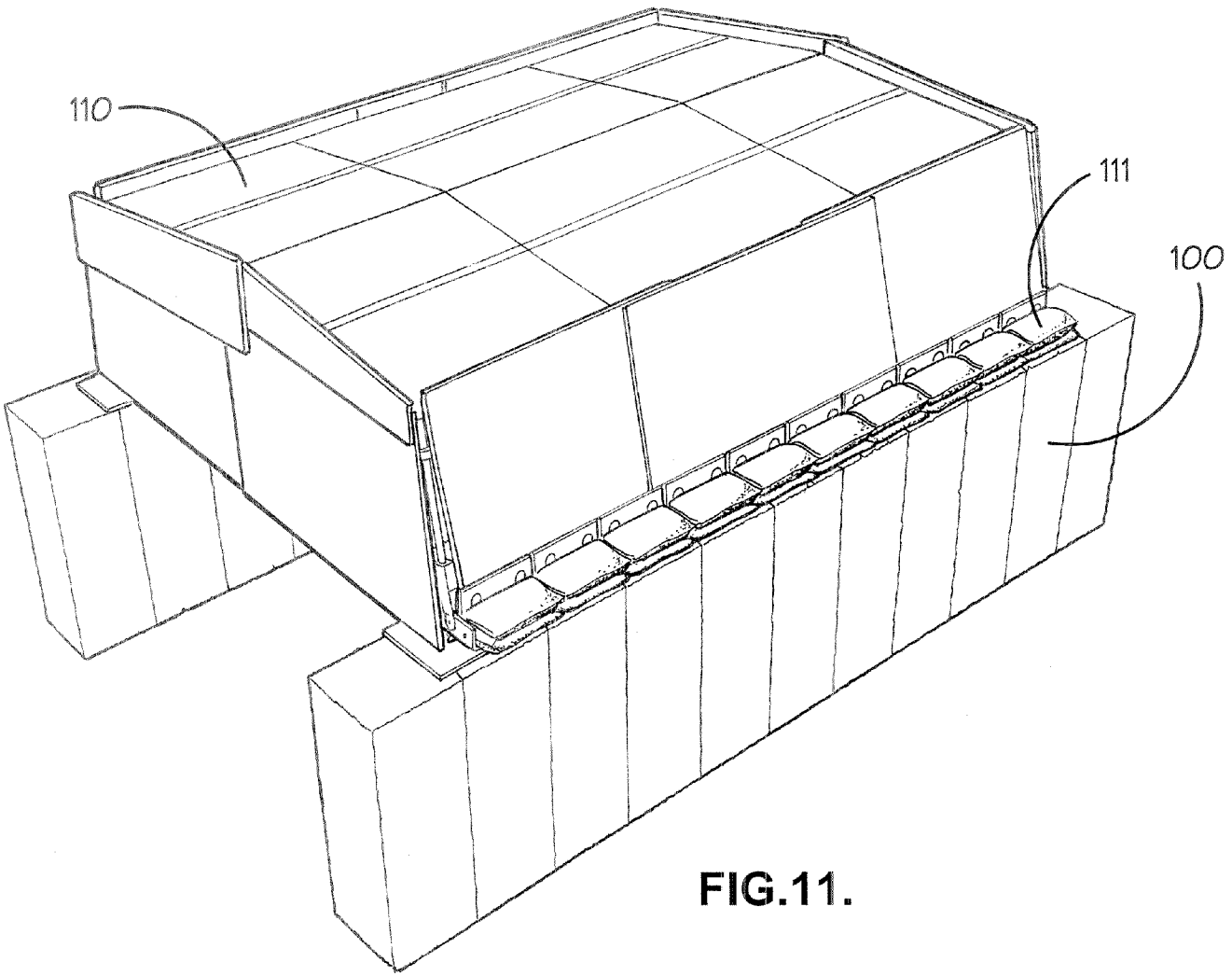
FIG. 11 is a perspective view of the FIG. 10 assembly with boarding around the framework to complete the pre-detonation screen.

Finally, as shown in FIG. 11*m* the pre-detonation screen may be fitted to the framework. In the case of FIG. 11, the pre-detonation screen is provided by a multiplicity of plywood panels 110, but many other arrangements and materials may be contemplated. The foot plates of each anchor assembly unit may additionally be buttressed by suitable materials—sandbags 111 are illustrated in FIG. 11.

The invention claimed is:

1. A protective shelter comprising opposite outer supports and a roof structure extending between the outer supports, wherein the roof structure comprises a plurality of tray members arranged to receive earth, sand or aggregate material defining an inner skin to provide a first level of protection in the roof structure, and the tray members are arranged to be slotted in between neighbouring transverse beams and supported by the transverse beams, wherein the transverse beams are arranged to be supported at respective ends by the opposite outer supports and wherein the transverse beams form a transverse beam bridge across the shelter such that the height of the shelter centrally, and away from the opposite supports is substantially the same as the height of said outer supports, further comprising a second laterally extending layer, spaced from and above the tray members and arranged so as to define a pre-detonation screen.

2. The protective shelter according to claim 1, wherein the transverse beam bridge is substantially flat.

3. The protective shelter according to claim 1, wherein the transverse beam bridge runs straight across the shelter from outer support to opposite outer support.

4. The protective shelter according to claim 1, wherein the transverse beam comprises a plurality of transverse beam members joined together end-to-end.

5. The protective shelter according to claim 4, wherein the transverse beam members are joined end-to-end by a connecting means.

6. The protective shelter according to claim 5, wherein the connecting means comprises a flitch plate.

7. The protective shelter according to claim 1, wherein the ends of the transverse beams are arranged to be supported by the outer supports.

8. The protective shelter according to claim 7, wherein the ends of the transverse beams are arranged to be received by anchor assemblies mounted on the outer supports.

9. The protective shelter according to claim 8, wherein the anchor assemblies serve to space the transverse beams along the length of the shelter.

10. The protective shelter according to claim 9, wherein the anchor assemblies are arranged such that each transverse beam is connected to, and sandwiched, except for the first and last beams, between, adjacent anchor assembly units.

11. The protective shelter according to claim 7, wherein the anchor assembly units, through their secure engagement to the transverse roof beams, provide for a rigid footing or a support structure that extends along the length of the upper surface of the walls of the shelter and thereby combine to effectively define a lintel transverse beam extending along the length of the wall.

12. The protective shelter according to claim 1, wherein the pre-detonation screen is spaced from the initial layer formed by the tray members and the soil, sand, aggregate layer by a distance in the order of from about 0.5 meters to about 2 meters.

13. The protective shelter according to claim 1, wherein the tray members comprise a series of inter connected identical tray members having mutually connectable engagement formations at opposite ends thereof.

14. The protective shelter according to claim 1, wherein each tray member comprises a plurality of tray sections.

15. The protective shelter according to claim 14, wherein each tray section is separated from neighbouring tray section by a stiffening flange to give extra structural robustness to the tray member.

16. A protective shelter comprising opposite outer supports and a roof structure extending between the outer supports, wherein the roof structure comprises a plurality of tray members arranged to receive earth, sand or aggregate material defining an inner skin to provide a first level of protection in the roof structure, and the tray members are arranged to be slotted in between neighbouring transverse beams and supported by the transverse beams, wherein the transverse beams are arranged to be supported at respective ends by the opposite outer supports and wherein the transverse beams form an arch-less transverse beam bridge across the shelter, further comprising a second laterally extending layer, spaced from and above the tray members and arranged so as to define a pre-detonation screen.

17. A protective shelter comprising opposite outer supports and a roof structure extending between the outer supports, wherein the roof structure comprises a plurality of tray members arranged to receive earth, sand or aggregate material defining an inner skin to provide a first level of protection in the roof structure, and the tray members are arranged to be slotted in between neighbouring transverse beams and supported by the transverse beams, wherein the transverse beams are arranged to be supported at respective ends by the opposite outer supports and wherein the transverse beams form an arch-less transverse beam bridge across the shelter such that the height of the shelter centrally, and away from the opposite supports is substantially the same as the height of said outer supports, further comprising a second laterally extending layer, spaced from and above the tray members and arranged so as to define a pre-detonation screen.

* * * * *